US011198554B2

(12) United States Patent
Lien

(10) Patent No.: US 11,198,554 B2
(45) Date of Patent: Dec. 14, 2021

(54) FACE MASK TIE MANAGEMENT INSERT

(71) Applicant: O & M Halyard, Inc., Mechanicsville, VA (US)

(72) Inventor: Khoa T. Lien, Alpharetta, GA (US)

(73) Assignee: O&M Halyard, Inc., Mechanicsville, VA (US)

( * ) Notice: Subject to any disclaimer, the term of this patent is extended or adjusted under 35 U.S.C. 154(b) by 340 days.

(21) Appl. No.: 16/200,806

(22) Filed: Nov. 27, 2018

(65) Prior Publication Data

US 2020/0165060 A1 May 28, 2020

(51) Int. Cl.
*B65D 83/08* (2006.01)
*B65B 35/50* (2006.01)

(52) U.S. Cl.
CPC ..... *B65D 83/0805* (2013.01); *B65B 35/50* (2013.01); *B65D 83/0835* (2013.01)

(58) Field of Classification Search
CPC B65D 83/0805; B65D 83/0835; B65D 85/15; B65D 85/18; B65D 5/542; B65D 5/724; B65D 35/50; A61B 50/30; A61B 42/40
USPC ..... 206/278, 438, 554, 494, 499, 526; 221/45, 33, 26, 303; 128/206.19, 863, 128/202.13, 206.13
See application file for complete search history.

(56) References Cited

U.S. PATENT DOCUMENTS 1,229,795 A * 6/1917 Sandholzer ..... A41D 13/1161 24/589.1
1,330,968 A * 2/1920 Woods ..... A41F 5/00 24/570
1,375,015 A 4/1921 Reynolds
1,540,244 A * 6/1925 Berglund ..... B65H 75/4473 242/405.1
1,634,436 A * 7/1927 Polson ..... B65H 75/06 242/405.2
1,655,065 A * 1/1928 Le Baron ..... B65H 75/06 242/405.2
1,762,558 A 6/1930 Mitchell
2,271,288 A * 1/1942 Cuff ..... D06F 53/00 24/130

(Continued)

FOREIGN PATENT DOCUMENTS

DE 7607669 U1 7/1976
FR 2350823 A1 12/1977

(Continued)

OTHER PUBLICATIONS

International Search Report and Written Opinion for PCT/IB2018/059357, dated Jul. 8, 2019, 14 pages.

*Primary Examiner* — J. Gregory Pickett
*Assistant Examiner* — Brijesh V. Patel
(74) *Attorney, Agent, or Firm* — Dority & Manning, P.A.

(57) ABSTRACT

An insert for managing tie strings of a plurality of face masks within a dispenser package is provided. The insert is intended for use with face masks that include a face mask body and at least left and right tie strings. The insert includes a body having a lower portion, an upper portion, a neck connecting the lower portion and the upper portion, and a cut-out portion for the tie strings formed between the lower portion, the neck, and the upper portion. A method of managing the tie strings of a plurality of face masks using the insert is also disclosed.

20 Claims, 4 Drawing Sheets

(56) References Cited

U.S. PATENT DOCUMENTS 2,287,368 A * 6/1942 Anderson ..... B65H 75/06 242/404.2
2,317,914 A * 4/1943 McIntyre ..... D04D 5/00 28/147
D136,783 S * 12/1943 Le Veck ..... D8/358
2,665,805 A * 1/1954 Schaefer ..... A61B 17/06128 206/63.3
2,772,056 A * 11/1956 Geisinger ..... B65H 75/4473 242/405.1
D180,332 S * 5/1957 Jackson ..... D8/358
3,136,418 A * 6/1964 Stacy ..... B65H 75/36 242/405.1
3,556,292 A * 1/1971 Krzyzanowski ... B65D 75/5805 206/464
D221,511 S * 8/1971 Dufault ..... B65H 75/36 242/405.1
3,626,495 A * 12/1971 Bastian, Jr. ..... B65H 75/06 242/405.2
3,736,925 A * 6/1973 Erman ..... A45D 44/22 606/204.35
3,746,286 A * 7/1973 Christoffel ..... A63H 27/002 244/155 A
3,942,682 A * 3/1976 McKay ..... A47K 10/422 221/58
D243,654 S * 3/1977 Burgoyne ..... B65D 71/08 D8/358
D255,506 S * 6/1980 Eubanks ..... B65H 75/36 242/405.1
4,269,315 A 5/1981 Boyce
4,414,716 A * 11/1983 Stastney ..... A41F 1/00 24/3.12
D276,942 S * 12/1984 Crews ..... D28/66
4,497,457 A * 2/1985 Harvey ..... B65H 75/36 242/405.1
4,550,856 A 11/1985 Ballmann et al.
D281,574 S * 12/1985 O'Hara, II ..... D8/358
4,615,435 A * 10/1986 Alpern ..... A61B 17/06138 206/63.3
4,673,084 A * 6/1987 Hubbard ..... B65D 5/541 D8/358
4,779,816 A * 10/1988 Varlet ..... B65H 75/06 24/910
4,877,154 A * 10/1989 Matsui ..... A47K 10/424 221/48
D337,718 S * 7/1993 Donaldson ..... D8/358
5,236,082 A * 8/1993 Brown ..... A61B 17/06138 206/382
D361,935 S * 9/1995 Johnson ..... A41F 5/00 D9/434
5,601,185 A * 2/1997 Behring ..... A61B 17/06138 206/380
5,615,767 A * 4/1997 Eull ..... B65D 5/5023 206/278
D395,999 S * 7/1998 Schmidt ..... A41F 5/00 D8/358
5,784,763 A * 7/1998 Cassidy ..... F16G 11/14 24/129 B
5,788,063 A * 8/1998 Van Ness ..... A61B 17/06138 206/380
6,003,672 A 12/1999 Chapman et al.
D424,389 S * 5/2000 Lindsey ..... A45D 44/22 D3/18
6,080,184 A * 6/2000 Peters ..... A61B 17/06133 206/63.3
6,142,405 A * 11/2000 Black ..... B65H 75/06 242/388.6
6,244,444 B1 * 6/2001 Jacobus ..... B65D 25/205 206/470
D461,115 S * 8/2002 Vassioukevitch ..... D8/360.1
6,763,970 B2 * 7/2004 Harris ..... B42D 5/005 221/45
6,802,471 B1 * 10/2004 Gambrell ..... B65D 83/0805 221/34
7,098,406 B1 * 8/2006 Hammonds ..... B65D 83/0805 221/34
7,404,487 B2 * 7/2008 Kumakura ..... B65D 71/08 206/467
D576,867 S * 9/2008 Kretz ..... B65D 83/0805 D8/356
7,814,821 B2 * 10/2010 Chenel ..... A45F 5/00 89/1.13
D689,303 S * 9/2013 Davison ..... B65D 83/0805 D6/580
8,568,190 B2 * 10/2013 Nelson ..... A63H 27/10 446/220
D710,671 S * 8/2014 Gonzalez ..... A01K 97/12 D8/105
9,688,433 B2 * 6/2017 Camedda ..... B65D 5/10
D839,084 S * 1/2019 Mikoska ..... B65H 75/06 D8/356
D880,296 S * 4/2020 Hamel ..... B65H 75/06 D9/443
2002/0040912 A1 * 4/2002 McHugh ..... B42D 5/005 221/45
2003/0005813 A1 1/2003 Villanueva
2004/0056043 A1 * 3/2004 Griesbach, III ... B65D 83/0805 221/34
2005/0051567 A1 * 3/2005 Bell ..... B42D 5/005 221/45
2007/0062843 A1 * 3/2007 Rudd ..... B42D 5/005 221/45
2007/0210096 A1 * 9/2007 Ellswood ..... B65D 83/0805 221/34
2008/0164276 A1 * 7/2008 Kan ..... B42D 5/005 221/45
2014/0224261 A1 * 8/2014 Tsuei ..... B65D 83/0805 128/863
2014/0250761 A1 * 9/2014 Preller, Jr. ..... A01K 97/12 43/17
2015/0191299 A1 * 7/2015 Tsuei ..... B65B 35/50 206/494
2017/0008691 A1 * 1/2017 DeGraaf ..... A61B 42/40
2018/0111744 A1 * 4/2018 Modha ..... B65D 83/0817
2018/0111745 A1 * 4/2018 Modha ..... B65D 5/724

FOREIGN PATENT DOCUMENTS

GB 2 241 489 A 9/1991
JP 2012136351 A 7/2012
WO WO 0223689 A1 3/2002
WO WO 2016/176017 A1 11/2016

* cited by examiner

FACE MASK TIE MANAGEMENT INSERT

FIELD OF THE INVENTION

The subject matter of the present invention relates generally to an insert for the packaging and dispensing of one of multiple face masks from a container without tangling the tie strings of the masks.

BACKGROUND

Surgeons, nurses, and other healthcare professionals often wear surgical masks to prevent the spread of infection through contact with the body fluids of patients. Additionally, healthcare professionals are often required to wear sterile surgical masks during surgical procedures to maintain the sterile environment. Non-sterile surgical masks are often formed of a flat, rectangular panel which covers the face of the wearer, with multiple ties or strings attached to the corners of the rectangular panel. In some instances, the sterile face mask additionally includes a transparent eye shield attached to the upper portion of the rectangular panel for protecting the wearer's eyes.

The masks are generally stacked, sold and stored together and are intended to be removed one by one for use. Inevitably, the tie strings of the stacked masks become tangled. The entangled tie strings require time and effort to separate the masks from each other, often leading to inadvertently handling the masks that remain in the package or removing multiple masks at once. Handling or removing the remaining masks from the package exposes the extra masks to microorganisms that may contaminate the extra masks. This contamination may expose patients to infections.

The only way to avoid such risk of contamination is to throw away all the masks that were handled when they were untangled, resulting in unnecessary waste. Because hospitals must both reduce costs and maintain sanitary conditions, contamination or waste of the masks is unacceptable.

An alternative packaging method for surgical masks involves individually folding each and every string of every mask such that the tie strings are isolated from one another before the masks are stacked and placed into a dispenser. This method generally requires manual folding of the tie strings, which incurs additional expensive manufacturing costs and tedious labor.

One solution is to provide a packaging container, such as a box, having an opening for dispensing the face masks and providing a separate compartment within the box for containing the tie strings to avoid entanglement. For example, a plurality of masks may be stacked and positioned so that all the strings hang in one direction forming two columns of tie strings hanging distal to the opening of the dispenser. U.S. Pat. No. 4,269,315 (Boyce); U.S. Pat. No. 4,673,084 (Hubbard et. al.); U.S. Pat. No. 5,615,767 (Eull et. al.); French patent FR 2350823; and German patent DE 7607669 disclose containers for dispensing face masks having compartments for gathering the tie strings. However, these containers are often formed from large, complex blanks of cardboard or other material and require complex folding and/or adhesives to maintain the structure of the container to separate the tie strings from the masks. As a result, these dispensers require additional manufacturing and assembly time and cost.

Furthermore, even with specialized containers as described above, the problem of handling or removing multiple masks at once is not eliminated. For example, some containers are so difficult to remove masks from that healthcare professionals tear off the lid to access the masks, leaving the remaining masks exposed to contamination.

Consequently, there is a need for a packaging solution that overcomes the shortcomings of existing packaging for dispensing of sterile face masks to reduce waste and contamination of the masks.

SUMMARY

The present invention is directed to an insert for managing tie strings of a plurality of face masks within a dispenser package, where each face mask includes a face mask body and left and right tie strings. The insert includes a body having a lower portion, an upper portion, a neck connecting the lower portion and the upper portion, and a cut-out portion for the tie strings formed between the lower portion, the neck, and the upper portion.

In one particular embodiment, the cut-out portion can include first and second channels.

In addition, the left and right tie strings of the face masks can be configured to extend through the first and second channels, respectively.

In one more embodiment, the upper portion of the insert can be wider than the lower portion of the insert.

In yet another embodiment, the upper portion of the insert can include a first flap and a second flap.

In addition, the first flap and the second flap can extend from opposing sides of the upper portion.

Further, the lower portion of the insert can define a first side edge and a second side edge, wherein the first flap can extend beyond the first side edge and the second flap can extend beyond the second side edge.

Moreover, the neck can include a fold region having a crease for folding the lower portion up to face the upper portion.

Additionally, the first and second flaps can be configured to be folded over first and second side edges of the lower portion towards a central axis of the insert, respectively, when the neck is folded at the crease to secure the left and right tie strings in the insert.

Further, a lower edge of each of the plurality of face masks can be configured to rest adjacent the fold region.

Moreover, the tie strings can be configured to extend in a direction distally from the fold region.

In still yet another embodiment, the ratio of the width of the neck to the width of the lower portion can range from about 1:1.5 to about 1:4.

In an additional embodiment, the ratio of the width of the lower portion to the width of the upper portion can range from about 1:1 to about 1:2.

In one more embodiment, the insert can be configured to secure the plurality of face masks by folding the body to hold the tie strings in place.

In yet another embodiment, the insert can be made of paper or cardboard material.

In still another embodiment, the insert can be made of a single layer of material.

In an additional embodiment, the insert can be formed in one piece.

In one more embodiment, the lower portion can have a width ranging from about 17.8 cm to about 25.4 cm.

In yet another embodiment, the upper portion can have a width ranging from about 25.4 cm to about 35.6 cm.

In still another embodiment, the neck can have a width ranging from about 6.3 cm to about 11.4 cm.

In one more embodiment, the lower portion can have a width ranging from about 17.8 cm to about 25.4 cm, the upper portion can have a width ranging from about 25.4 cm to about 35.6 cm, and the neck can have a width ranging from about 6.3 cm to about 11.4 cm.

The present invention additionally relates to a face mask tie management system. The face mask tie management system includes a package for dispensing face masks, wherein the package includes an opening for dispensing the face masks, and an insert. The insert can include a body having a lower portion, an upper portion, a neck connecting the lower portion and the upper portion, and a cut-out portion for the tie strings formed between the lower portion, the neck, and the upper portion.

In another embodiment of the face mask tie management system, the system further includes a stack of face masks, wherein the tie strings of the stack of face masks can be secured by the insert, wherein the stack of face masks having tie strings secured by the insert can be positioned inside the package such that the face masks can be dispensed from the package one at a time.

The present invention further relates to a method of managing tie strings of a plurality of face masks for dispensing the plurality of face masks. Each face mask can include a face mask body and left and right tie strings. The method includes steps of:

providing the plurality of face masks in a stack, wherein the mask bodies are stacked on top of each other; providing an insert for managing the tie strings of the plurality of face masks, the insert including a body having a lower portion, an upper portion, and a neck connecting the lower portion and the upper portion; and a cut-out portion for the tie strings, wherein the cut-out portion comprises first and second channels formed by the lower portion, the neck, and the upper portion; positioning the left and right tie strings through the first and second channels of the insert, respectively; folding the lower portion of the insert up toward the upper portion; and securing the tie strings by folding flaps on each opposing end of the upper portion over respective side edges of the lower portion towards a central axis of the insert to secure the insert in a folded configuration.

These and other features, aspects, and advantages of the present invention will become better understood with reference to the following description and appended claims. The accompanying drawings, which are incorporated and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
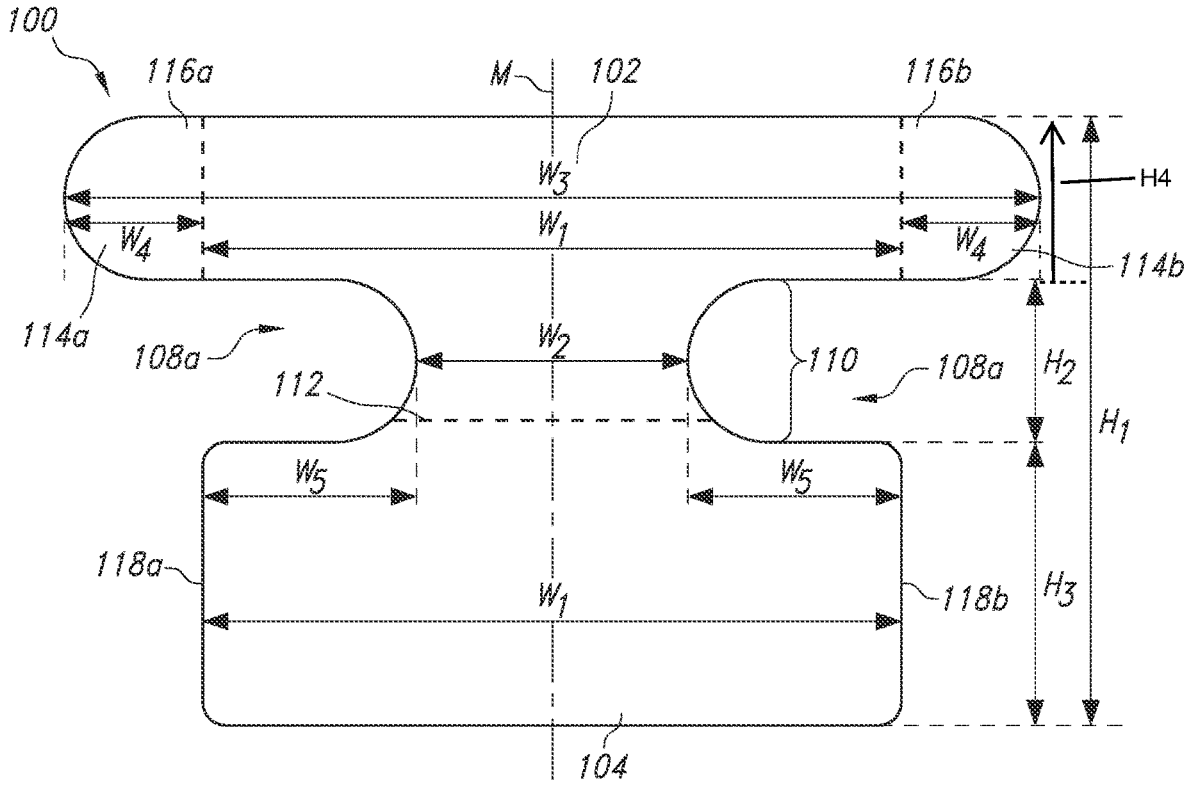
FIG. 1 is a top view of a tie management insert according to the present invention before the insert has been folded or assembled with a stack of face masks to secure the stack of masks.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally speaking, the present invention is directed to a tie management system comprising an insert for managing the tie strings of a stack of surgical masks within a container. The insert has left- and right-side channels to segregate the respective left and right tie strings of the stack of surgical masks during packaging and to prevent the inadvertent dispensing of multiple face masks at once. Further, the tie management insert has a lower portion, an upper portion, a neck and a cut-out portion which form the channels. The neck comprises a fold region from which the lower portion is folded up toward the upper portion. The bottom edges of the stack of surgical face masks are configured to rest adjacent to the fold region. Further, the upper portion has left- and right-side flaps that are folded over the left- and right-side edges of the lower portion when the lower portion is folded upward at the fold region. The flaps of the upper portion secure the upper portion to the lower portion to hold the segregated tie strings, and thus the surgical masks, in place.

Referring now to FIG. 1, a tie management insert 100 contemplated by the present invention is shown in a flat, unfolded configuration before the insert has been folded and secured about the tie strings in a stack of face masks. The insert 100 has an upper portion 102, a lower portion 104, and a neck 106 connecting the upper portion 102 and the lower portion 104. The insert 100 further has a cut-out portion 110 formed between the upper portion 102, the neck 106, and the lower portion 104. The cut-out portion 110 includes a first channel 108*a* and a second channel 108*b*. The neck 106 may also define a fold region where the insert 100 may be folded such that the lower portion 104 is folded up toward the upper portion 102. Specifically, the fold may occur at the crease 112 located on a portion of the neck 106 adjacent to the lower portion 104. The crease 112 may approximately bisect a height $h_1$ of the insert 100, although it is to be understood that the crease 112 may be located anywhere along a height $h_2$ of the of the neck 106. The crease 112 may be generally perpendicular to a central axis or midline M of the insert 100. The upper portion 102 of the insert 100 further includes a first flap 114*a* and a second flap 114*b* which are used to secure the upper portion 102 to the lower portion 104 when the insert 100 is in the folded configuration. The first and second flaps 114*a* and 114*b* each extend wider than respective first and second side edges 118*a* and 118*b* of the lower portion 104. The first flap 114*a* and second flap 114*b* have first and second fold lines 116*a* and 116*b*, respectively. The fold lines 116*a* and 116*b* are approximately parallel to and can be aligned with the first and second side edges 118*a* and 118*b* of the lower portion 104.

The insert 100 can be formed in one piece out of a paper, stock, or cardboard material. The insert can also be formed in one piece out of a rigid or semi-rigid plastic material. In one embodiment, a single layer of material is used. As will be demonstrated below, no adhesive or fastener is required or used to hold the insert 100 in its final folded configuration.

As shown in FIG. 1, the lower portion 104 has an outer width $w_1$ extending between the first and second side edges 118*a* and 118*b* of the lower portion 104. The neck has an inner width $w_2$. The upper portion 102 has an outer width $w_3$. The flaps 114*a* and 114*b* each have a flap width $w_4$. The sides of the lower portion 104 extending wider than the inner width $w_2$ of the neck 106 have a width $w_5$. As mentioned above, the insert 100 has an overall height $h_1$ and the neck 106 and the channels 108*a* and 108*b* of the cut-out portion 110 have a height $h_2$. The lower portion 104 has a height $h_3$. The upper portion 102 has a height $h_4$.

The outer width $w_1$ of the lower portion 104 may range from about 7 inches (17.8 cm) to about 10 inches (25.4 cm), such as from about 8 inches (20.3 cm) to about 9 inches (22.9 cm). In one particular embodiment, the outer width $w_1$ of the lower portion 104 may be about 8.6 inches (21.84 cm). The inner width $w_2$ of the neck 106 may range from about 2.5 inches (6.35 cm) to about 4.5 inches (11.4 cm), such as from about 3 inches (7.6 cm) to about 4 inches (10.2 cm). In one particular embodiment, the inner width $w_2$ of the neck 106 may be about 3.33 inches (8.46 cm). The ratio of the width $w_2$ of the neck 106 to the width $w_1$ of the lower portion 104 may range from about 1:1.5 to about 1:4. The outer width $w_3$ of the upper portion 102 may range from about 10 inches (25.4 cm) to about 14 inches (35.6 cm), such as from about 11 inches (27.9 cm) to about 13 inches (33 cm). In one particular embodiment, the outer width $w_3$ of the upper portion 102 may be about 12 inches (30.48 cm). The ratio of the width $w_1$ of the lower portion 104 to the width $w_3$ of the upper portion 102 may range from about 1:1 to about 1:2. The flap width $w_4$ may range from greater than 0 inches (0 cm) to about 2 inches (5.1 cm). The width $w_5$ of the sides of the lower portion 104 extending wider than the inner width $w_2$ of the neck 106 may range from about 1.25 inches (3.2 cm) to about 3.75 inches (9.5 cm). The height $h_1$ of the insert 100 may range from about 5 inches (12.7 cm) to about 10 inches (25.4 cm), such as from about 6 inches (15.2 cm) to about 9 inches (22.9 cm). In one particular embodiment, the height $h_1$ of the insert 100 may be about 7.5 inches (19.05 cm). The height $h_2$ of the neck 106 and the channels 108*a* and 108*b* of the cut-out portion 110 may range from about 1 inch (2.5 cm) to about 3 inches (7.6 cm), such as from about 1.5 inches (3.8 cm) to about 2.5 inches (6.6 cm). In one particular embodiment, the height $h_2$ of the neck 106 and the channels 108*a* and 108*b* may be about 2 inches (2.08 cm). In addition, the height $h_3$ of the lower portion 104 can be approximately one half the total height $h_1$ of the insert.

Figure 2:
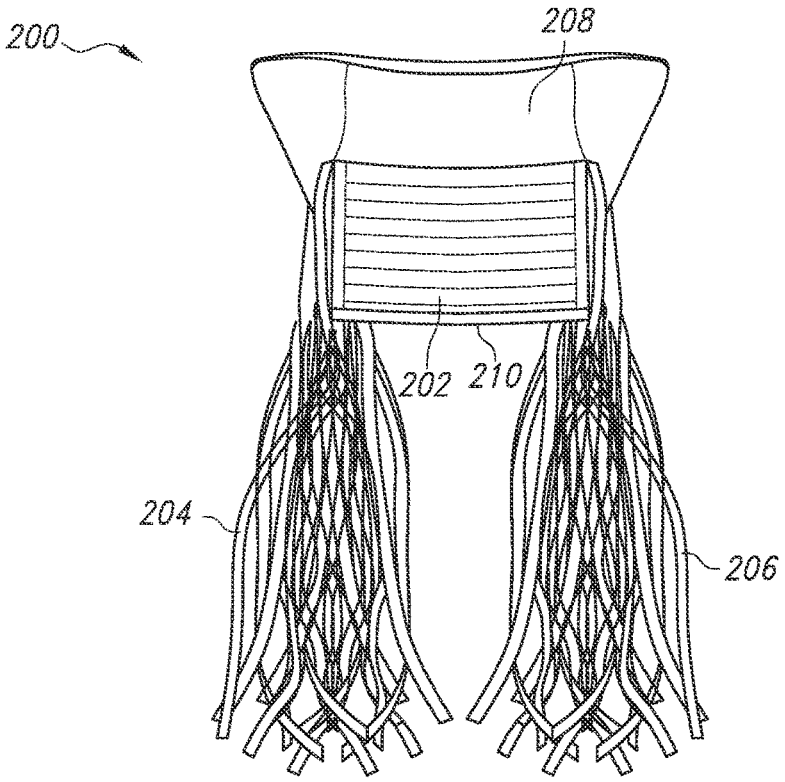
FIG. 2 is a rear view of an exemplary stack of face masks which may be used with the insert of FIG. 1.

Next, FIG. 2 shows a rear view of an exemplary stack of masks 200 that can be secured by the insert 100 of the present invention. The stack of masks 200 includes rectangular-shaped mask bodies 202 formed of conventional surgical mask material, such as a multi-layered material which is permeable to air. The mask bodies 202 have a bottom edge 210. Attached to an upper edge of each of the mask bodies 202 is an eye shield 208 formed of substantially transparent, flexible material. The mask bodies 202 each have a means for securing the mask on the face of the wearer. Advantageously, this can be a pair of tie strings on each side of the surgical mask body 202 forming left tie strings 204 and right tie strings 206. Moreover, it is to be understood that although the means for securing the mask is shown as a pair of left 204 and right 206 tie strings, tie strings or other elongated fasteners may be present in other quantities than those specifically shown in FIG. 2.

Turning now to FIGS. 3-6, the steps for assembling the insert 100 to secure the tie strings of the stack of masks 200 are illustrated.

Figure 3:
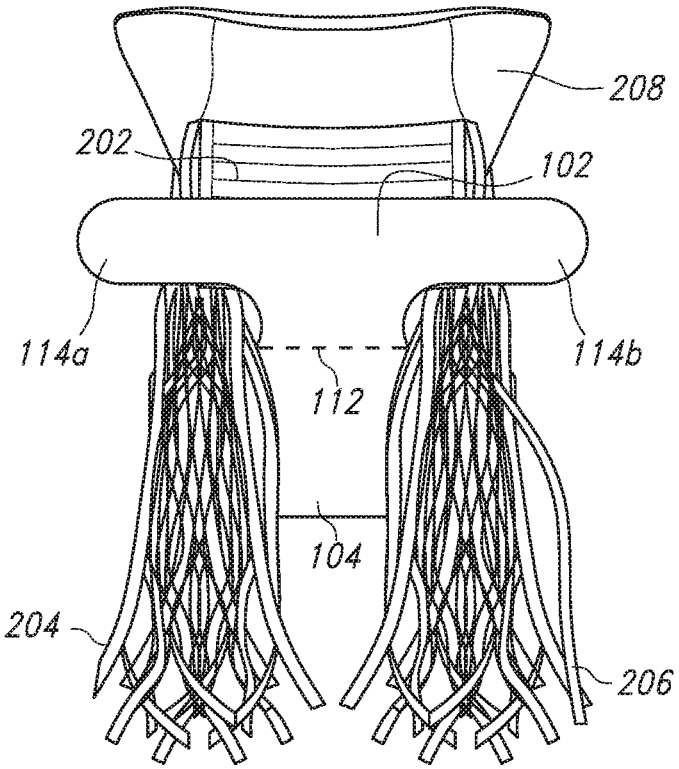
FIG. 3 is a rear view of the partially-assembled tie management insert of FIG. 1 with a stack of face masks in which the tie strings of the face masks have been received in the channels of the insert.

First, the insert 100 is positioned over the back of the stack of masks 200 such that the upper portion 102 of the insert 100 contacts the rear of the rectangular mask bodies 202. The left-side tie strings 204 are gathered and pulled through the first channel 108*a* of the insert 100, and the right-side tie strings 206 are gathered and pulled through the second channel 108*b*, such that the left-side tie strings 204 and the right-side tie strings 206 lay on top of the lower portion 104 of the insert 100, as shown in FIG. 3. The free ends of the tie strings 204 and 206 extend distally away from the neck 106 and crease 112.

Figure 4:
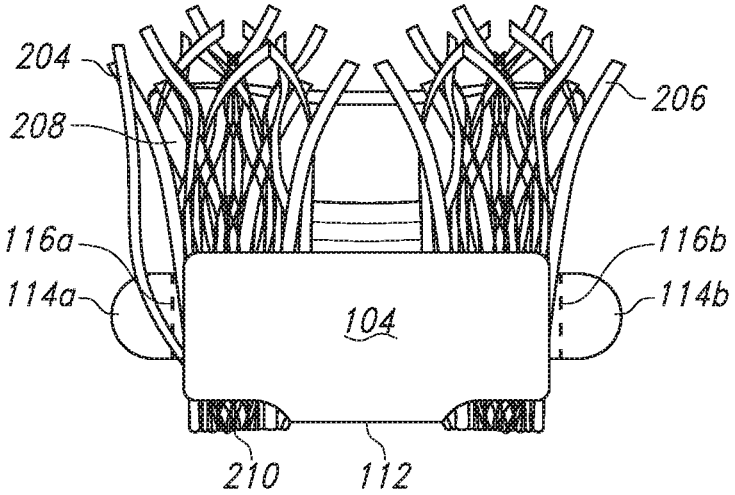
FIG. 4 is a rear view of the partially-assembled tie management insert of FIG. 1 with a stack of face masks in which the rear portion of the insert has been folded upward.

Next, the insert 100 is folded along the crease 112 so that the lower portion 104 is folded upward to face the upper portion 102. At the same time, the gathered left-side tie strings 204 and right-side tie-strings 206 are brought upward such that the left-side tie strings 204 and the right-side tie strings 206 lay on top of the upper portion 102 and the eye shields 208, as shown in FIG. 4, so that the free ends of the tie strings 204 and 206 remain extending distally from the neck 106 and crease 112. In this configuration, the flaps 114*a* and 114*b* of the upper portion 102 extend out toward the left and right sides, respectively, wider than the width $w_1$ of the lower portion.

Figure 5:
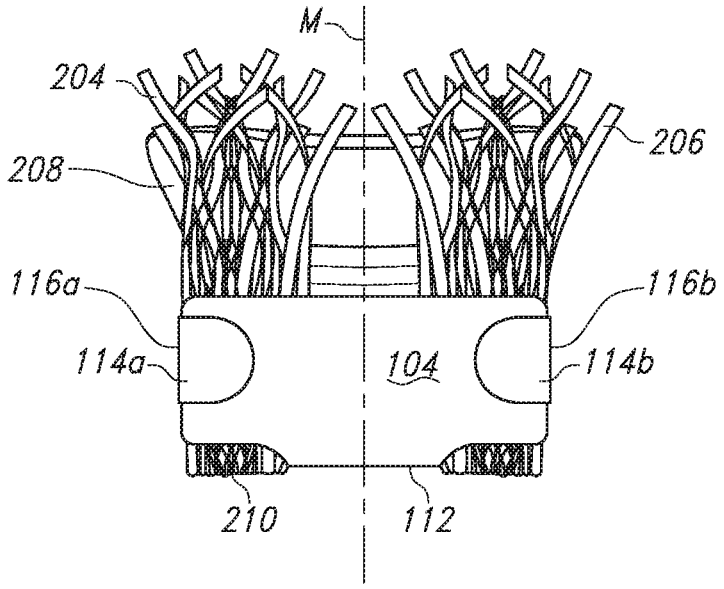
FIG. 5 rear view of an assembled configuration of the tie management insert wherein the insert has secured a stack of face masks.

Finally, the first flap 114*a* is folded along fold line 116*a* towards the central axis or midline M of the insert 100 such that flap 114*a* contacts and secures the first side edge 118*a* of the lower portion 104, and the second flap 114*b* is folded along fold line 116*b* towards a central axis or midline M of the insert 100 such that flap 114*b* contacts and secures the second side edge 118*b* of the lower portion 104, as shown in FIG. 5. In this final folded configuration of the tie management insert system, the stack of masks 200 is secured within the folded insert 100. The left- and right-side tie strings 204 and 206 remain secured in their respective channels 108*a* and 108*b* and segregated from each other. The tie strings are further segregated from the mask bodies 202 so that the groups of tie strings 204 and 206 are secured from being pulled out by the dispensing of a mask.

Figure 6:
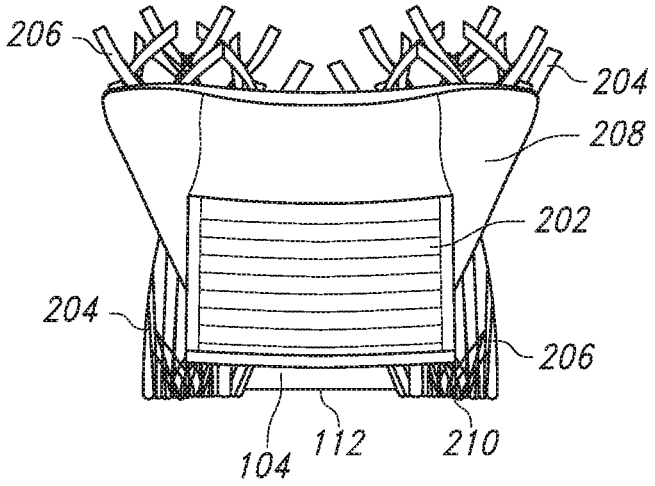
FIG. 6 is a front view an assembled configuration of the tie management insert wherein the insert has secured a stack of face masks.

FIG. 6 illustrates a front view of this final folded and secured configuration. In this configuration, only one mask of the stack of masks 200 is visible from an exposed surface for access at any given time.

Figure 7:
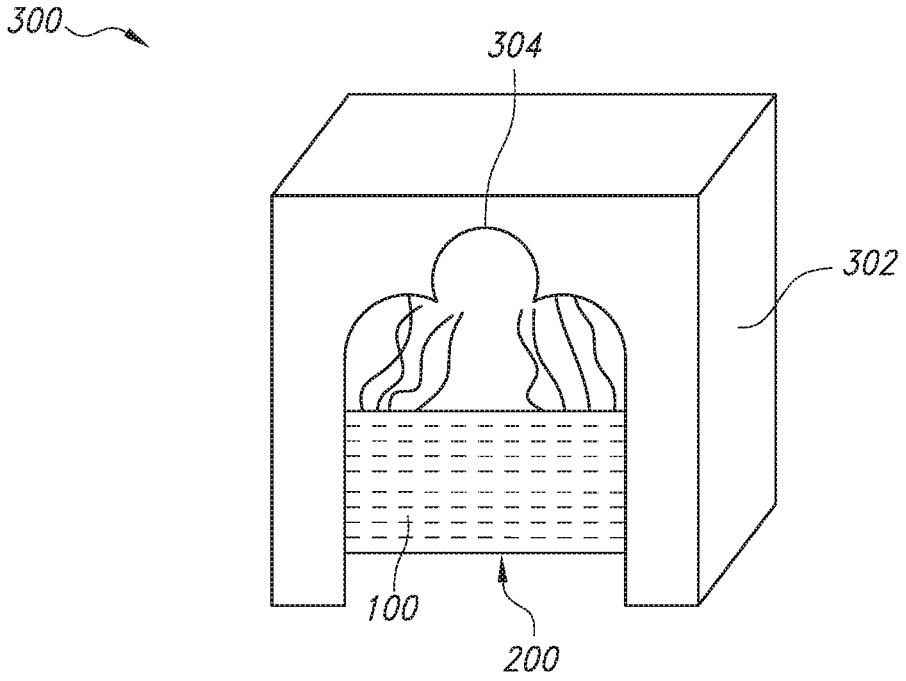
FIG. 7 is a perspective view of the tie management system of the present invention wherein the tie management insert has secured a stack of face masks and is placed within a dispenser.

As shown in FIG. 7, the final folded and secured stack of masks 200 about the insert 100 may then be inserted into any suitable package or dispenser 302 as part of a face mask dispensing system 300. The dispenser 302 may include an aperture 304 through which the front mask of the stack of masks 200 is exposed and may be removed, as seen in FIG. 7. As the front exposed mask is removed, the tie strings 204 and 206 connected thereto slide through the channels 108*a* and 108*b* of the insert 100 and out the aperture 304. The segregated channels 108*a* and 108*b* therefore prevent the ties 204 and 206 from becoming entangled with one another and allows smoother release of the mask from the dispenser 302. As a result, the removal of the front mask of the stack of masks 200 will not result in the removal or handling of other masks in the stack 200.

The tie management insert 100 of the present invention significantly reduces the occurrence of both packaging defects and dispensing errors of a stack of masks 200 within a box or container in the clinical setting.

Samples of three different types of dispensers for surgical masks were tested to evaluate the reduction in waste generated by the tie management insert of the present invention (Code H) as compared to a current mask dispenser (Code C) and a leading competitor's mask dispenser (Code R). In the study, dispensers were place on a shelf that simulated a hospital operating room scrub area. Healthcare professionals, who were the test subjects, were instructed to dispense a mask as they would in a clinical environment. The test results are provided in Tables 1 and 2 below.

TABLE 1

| | Dispensing Errors | Total Dispensed | % of Dispensing Errors |
|---|---|---|---|
| Code C | 42 | 210 | 20.0% |
| Code H | 8 | 200 | 4.0% |
| Code R | 7 | 99 | 7.1% |

As shown in Table 1, the tie management system of the present invention (Code H) yielded significantly fewer dispensing errors as compared to the current and competitive mask dispensers.

TABLE 2

| | Packaging Errors | Total Dispensed | % of Dispensing Errors |
|---|---|---|---|
| Code C | 33 | 210 | 15.7% |
| Code H | 8 | 200 | 4.0% |
| Code R | 7 | 99 | 7.1% |

As shown in Table 2, the tie management system of the present invention (Code H) yielded significantly fewer packaging defects as compared to the current and competitive mask dispensers.

Due to the significant reduction in both dispensing errors by healthcare professionals, and packaging defects of the mask dispenser, the tie management insert system of the present invention had a significant reduction in overall waste as compared to the current and competitive mask dispensers.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An insert for managing tie strings of a plurality of face masks within a dispenser package, the insert comprising:

a body having a lower portion, an upper portion, and a neck connecting the lower portion and the upper portion, wherein the upper portion comprises a first flap and a second flap extending from opposing sides of the upper portion, wherein the upper portion is wider than the lower portion, further wherein each of the lower portion, the upper portion, and the neck has a height extending in a vertical direction, wherein the height of the lower portion is greater than the height of the upper portion and the height of the lower portion is greater than the height of the neck; and a cut-out portion formed between the lower portion, the neck, and the upper portion, wherein the cut-out portion is configured to receive left and right tie strings of a plurality of face masks.

2. The insert of claim 1, wherein the cut-out portion comprises first and second channels.

3. The insert of claim 2, wherein the first and second channels are configured to receive the left and right tie strings of the plurality of face masks, respectively.

4. The insert of claim 1, wherein the lower portion defines a first side edge and a second side edge, wherein the first flap extends beyond the first side edge and the second flap extends beyond the second side edge.

5. The insert of claim 1, wherein the neck comprises a fold region having a crease for folding the lower portion up to face the upper portion.

6. The insert of claim 5, wherein the first and second flaps are configured to be folded over first and second side edges of the lower portion towards a central axis of the insert, respectively, when the neck is folded at the crease, such that the insert is configured to secure the left and right tie strings of the plurality of face masks in the insert.

7. The insert of claim 5, wherein the fold region is configured to receive a lower edge of each of the plurality of face masks.

8. The insert of claim 5, wherein the insert is configured to receive the plurality of face masks such that the left and right tie strings are configured to extend in a direction distally from the fold region.

9. The insert of claim 1, wherein a ratio of a minimum width of the neck to a maximum width of the lower portion ranges from about 1:1.5 to about 1:4.

10. The insert of claim 1, wherein a ratio of a maximum width of the lower portion to a maximum width of the upper portion ranges from about 1:1 to about 1:2.

11. The insert of claim 1, wherein the insert is configured to secure the plurality of face masks by folding the body to hold the tie strings in place.

12. The insert of claim 1, wherein the insert is comprised of paper or cardboard material.

13. The insert of claim 1, wherein the insert is comprised of a single layer of material.

14. The insert of claim 1, wherein the insert is formed in one piece.

15. The insert of claim 1, wherein the lower portion has a width ranging from about 17.8 cm to about 25.4 cm.

16. The insert of claim 1, wherein the upper portion has a width ranging from about 25.4 cm to about 35.6 cm.

17. The insert of claim 1, wherein the neck has a width ranging from about 6.3 cm to about 11.4 cm.

18. The insert of claim 1, wherein the lower portion has a width ranging from about 17.8 cm to about 25.4 cm, the upper portion has a width ranging from about 25.4 cm to about 35.6 cm, and the neck has a width ranging from about 6.3 cm to about 11.4 cm.

19. A face mask tie management system comprising:

a package for dispensing face masks, wherein the package includes an opening for dispensing face masks; and the insert according to claim 1.

20. The face mask tie management system of claim 19, further comprising a stack of face masks, wherein the tie strings of the stack of face masks are secured by the insert, wherein the stack of face masks having tie strings secured by the insert is positioned inside the package such that face masks in the stack of face masks are configured to be dispensed from the package one at a time.

* * * * *